US005839886A

United States Patent [19]

Shaw

[11] Patent Number: 5,839,886

[45] **Date of Patent: *Nov. 24, 1998**

[54] SERIES CONNECTED PRIMARY AND BOOSTER COMPRESSORS

[76] Inventor: David N. Shaw, 200 D Brittany Farms Rd., New Bristain, Conn. 06053

[ * ] Notice: This patent issued on a continued prosecution application filed under 37 CFR 1.53(d), and is subject to the twenty year patent term provisions of 35 U.S.C. 154(a)(2).

[21] Appl. No.: 644,744

[22] Filed: May 10, 1996

[51] Int. Cl.[6] ..... F04B 3/00

[52] U.S. Cl. ..... 417/250; 62/470; 62/510; 417/249

[58] Field of Search ..... 62/175, 510, 468, 62/470; 417/244, 245, 249, 250, 252

[56] References Cited

U.S. PATENT DOCUMENTS

| | | | |
|---|---|---|---|
| 2,243,541 | 5/1941 | Swart . | |
| 2,352,581 | 6/1944 | Winkler . | |
| 2,646,212 | 7/1953 | Kellie . | |
| 2,663,164 | 12/1953 | Kurtz . | |
| 3,226,949 | 1/1966 | Gamache . | |
| 3,500,962 | 3/1970 | Kocher . | |
| 3,719,057 | 3/1973 | Grant | 62/510 X |
| 3,775,995 | 12/1973 | Conley et al. | 62/510 X |
| 3,785,169 | 1/1974 | Gylland, Jr. | 62/468 |
| 3,859,815 | 1/1975 | Kasahara . | |
| 4,205,537 | 6/1980 | Dubberley | 62/510 |
| 4,236,876 | 12/1980 | Fraser et al. | 417/250 |
| 4,268,291 | 5/1981 | Cann . | |
| 4,306,420 | 12/1981 | Cann | 62/510 X |
| 5,094,085 | 3/1992 | Irino . | |
| 5,095,712 | 3/1992 | Narreau . | |
| 5,236,311 | 8/1993 | Lindstrom | 62/510 X |

FOREIGN PATENT DOCUMENTS

| | | |
|---|---|---|
| 0 106 414 | 4/1984 | European Pat. Off. . |

*Primary Examiner*—Ronald C. Capossela
*Assistant Examiner*—Susanne C. Tinker
*Attorney, Agent, or Firm*—Fishman, Dionne, Cantor & Colburn

[57] ABSTRACT

A primary compressor and a booster compressor connected in series is presented. A first conduit connects the low side of a heating/cooling or refrigeration system to the inlet of the booster compressor, the outlet of the booster compressor and the inlet of the primary compressor. A second conduit connects the outlet of the primary compressor to the high side of the system. The first conduit includes a check valve for closing or opening the connection between the first conduit and the outlet of the booster compressor. A sump conduit is positioned near the bottom of the primary and booster compressors to allow lubricant to flow from the booster compressor to the primary compressor.

29 Claims, 7 Drawing Sheets

HEAT PUMP WITH BOOSTER COMPRESSOR
HEATING
(FLOW PATH SHOWN)

HEAT PUMP WITH BOOSTER COMPRESSOR COOLING (FLOW PATH SHOWN)

SERIES CONNECTED PRIMARY AND BOOSTER COMPRESSORS

BACKGROUND OF THE INVENTION

The present invention relates generally to heating/cooling and refrigeration systems that utilize primary and booster compressors. More particularly, the present invention relates to a configuration of interconnecting a booster compressor and a primary compressor in series.

U.S. Pat. No. 4,748,820 to Shaw, which is incorporated herein by reference, discloses a refrigeration system which is disposed in two or more distinct locations, i.e. an equipment room and a plurality of remotely disposed display cases each of which defines a distinct refrigerating or product cooling zone or location remote from the equipment room, or at least disposed a substantial distance therefrom. Disposed in the equipment room are a plurality of high-stage compressors all connected in parallel between a suction line and a discharge line.

Compressed gaseous refrigerant flows from the discharge line to a condenser where it is condensed in the usual manner to a relatively warm liquid, which flows through a liquid line to a conventional receiver. A portion of the warm liquid refrigerant taken from the bottom of a receiver flows through a liquid line to an expansion valve, from which the expanded refrigerant flows through a sub-cooler to a line communicating directly with the suction line. The remaining portion of the warm liquid refrigerant flowing from the bottom of the receiver travels via a liquid line to the sub-cooler, where it is cooled by the expanded refrigerant flowing through the expansion valve, the resulting cooled liquid refrigerant then flowing from the sub-cooler through a line to each of the display cases. A liquid/suction heat exchanger is disposed in the display case, where liquid refrigerant is further precooled by the cold refrigerant vapor leaving the evaporator. From the heat exchanger the cooled liquid flows via a liquid line to an expansion valve. Reduced pressure refrigerant leaving the expansion valve then flows through a conventional evaporator coil to cool the product disposed in the display case, and from there it flows through the heat exchanger into the suction side of a booster compressor disposed within display case. The expansion valve is controlled in a typical manner by the pressure and temperature of the gaseous refrigerant leaving the evaporator. Each booster compressor acts as a system low stage compressor and is controlled solely by the cooling demand of the refrigerating zone in the display case in which it is disposed. The output from each booster compressor is communicated by a gas discharge line to the suction line of the primary compressor(s).

One problem often encountered in multiple compressor systems is the migration of oil to certain of the compressors, rather than being relatively uniformly distributed throughout the system, which ultimately if not controlled can cause lubricant starvation of one or more compressors. This problem has been solved in the prior art by the use of the liquid refrigerant lines to transfer controlled amounts of lubricant to all of the remotely located booster compressors, rather then by having to run separate oil lines to each of the booster compressors from a common oil sump in the condensing equipment location.

A conventional oil separator is connected into the discharge line between the most-downstream high-stage compressor and the condenser. Discharge gas from the high-stage compressors enters the separator and impinges against a baffle which facilitates the separation of any oil entrained therein, the oil dropping to an oil sump at the bottom of the separator, with the discharge vapor continuing on its way to the condenser via the discharge line. The oil separator has a float valve therein which controls the flow of lubricant from the sump through a conduit to an oil reservoir. The float valve is arranged so that when the level of the sump is above a predetermined amount the valve is opened and oil is permitted to flow to the reservoir, and when the sump is below that level the float valve is closed to prevent unwanted flow of vapor. The oil reservoir is connected to the high-stage compressor(s) in the usual manner. The high stage refrigeration compressors of the semi-hermetic type are provided with an oil sump with a float valve therein. The bottom of the reservoir is connected via a conduit to the float valve so that when the oil in-the sump drops below a predetermined level the float valve opens and permits oil to flow from the reservoir to the compressor sump. When the level is at or above this predetermined level the float valve is closed to prevent such flow of oil.

U.S. Ser. No. 08/607,707, filed Feb. 27, 1996, entitled Boosted Air Source Heat Pump, which is incorporated herein by reference, discloses a closed loop heat pump system and control. The closed loop system includes a first or booster stage compressor, a second or high stage primary compressor, an indoor coil or condenser which delivers heated air to a space to be heated, an economizer, and an outdoor coil or evaporator which, together with a conduit interconnecting these elements in a closed loop circuit, are basic components of the closed loop heat pump system. The high stage or primary compressor is normally operating whenever the heat pump system is delivering energy, but the booster compressor is operated only when the ambient temperature approaches or falls below the balance point for the primary compressor. Warm output vapor of the primary or second stage compressor is fed to the inlet of the indoor coil to warm air flowing over the indoor coil for delivery to the indoor space to be heated. The warm vapor is, of course, cooled and condensed in the indoor coil. The indoor coil delivers the condensed refrigerant flow to the economizer. A bypass or bleed line permits a portion of the liquid refrigerant to be bled from the primary closed loop circuit and to expand via an expansion valve within the economizer. The expansion of this bled refrigerant within the economizer results in significant subcooling of the liquid refrigerant which flows in a closed conduit through the economizer. This highly subcooled liquid refrigerant expands via an expansion valve into and within the evaporator to perform the function of absorbing energy from the outside air flowing over the outdoor coil and vaporizing in the evaporator. The amount of energy absorbed within the evaporator is greatly increased because of the subcooled refrigerant delivered from the economizer to the evaporator. The refrigerant vapor from the evaporator then flows to the suction or low side of the primary compressor to complete the closed loop circulation in effect when only the primary compressor is operating.

If the temperature of the space to be heated is at or above the desired temperature, both of the compressors are off and there is no heat flow in the system. If the temperature of the space to be heated falls below the set temperature, the primary compressor is turned on. The primary compressor will then deliver compressed refrigerant vapor to the indoor coil to heat the air flowing into the space to be heated, with the rest of the system functioning as previously described. When indoor temperature drops to the point that the set temperature cannot be satisfied by the primary compressor, the booster compressor is turned on.

As is well known in the art, a heat pump may also be operated as an air conditioner, whereby the flow of refrigerant is reversed. It will be appreciated that the flow of refrigerant to or around the booster compressor and the primary compressor remains the same in both modes. In the air conditioning mode, the indoor coil functions as an evaporator and the outdoor coil functions as a condenser.

The prior art system described in U.S. Pat. No. 4,748,820, requires a receiver to collect the condensed, warm refrigerant. In addition, an oil separator and oil reservoir are needed to ensure that no compressor suffers from lubricant starvation.

SUMMARY OF THE INVENTION

The above-discussed and other drawbacks and deficiencies of the prior art are overcome or alleviated by the novel series connection of the primary and booster compressors. The present invention is an arrangement for coupling a primary compressor and a booster compressor in series. A first conduit connects the low side of a heating/cooling or refrigeration system to the inlet of the booster compressor, the outlet of the booster compressor and the inlet of the primary compressor. A second conduit connects the outlet of the primary compressor to the high side of the system. The first conduit includes a check valve for closing or opening the connection between the first conduit and the outlet of the booster compressor. A sump conduit is positioned near the bottom of the primary and booster compressors to allow lubricant to flow from the booster compressor to the primary compressor.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
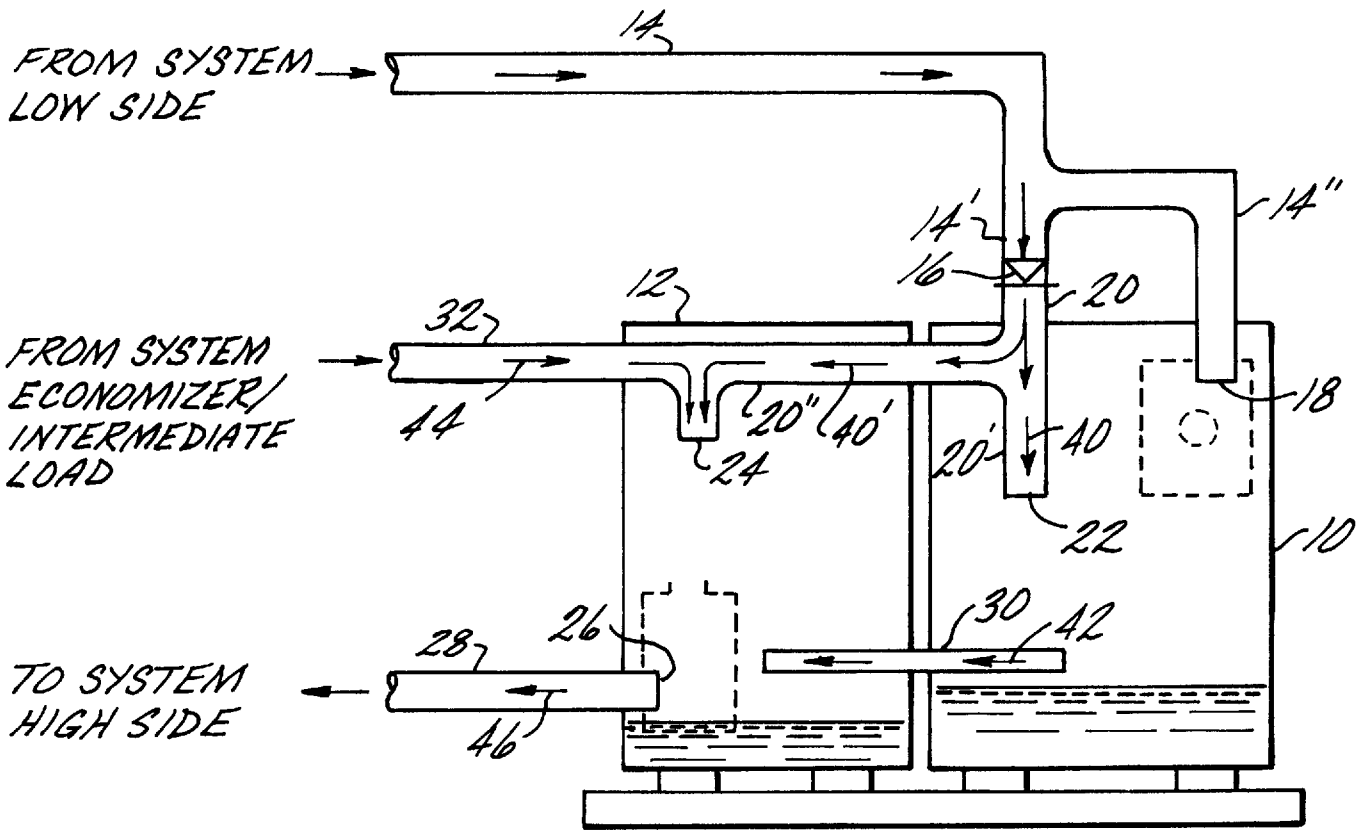
FIG. 1 is a diagrammatic sectional view of a primary and booster compressor in a first mode of operation.

Referring now to FIG. 1, a preferred configuration of interconnecting a booster stage or booster compressor 10 in series with a high stage primary compressor 12 is generally shown. A conduit 14 for receiving flow from the low side of a system, e.g., an evaporator, branches into a conduit 14' which is connected to a check valve 16 at booster compressor 10 and a conduit 14" which is connected to an inlet 18 of booster compressor 10. A conduit 20 is connected to check valve 16 and branches into a conduit 20' which is connected to an outlet 22 of booster compressor 10 and a conduit 20" which is connected to an inlet 24 of primary compressor 12. An outlet 26 of primary compressor 12 is connected by a conduit 28 for delivering flow to the high side of the system, e.g., a condenser. A sump conduit 30 is connected between compressors 10 and 12 at the lower portions thereof, as will be described in more detail hereinafter. Also, a conduit 32 for receiving flow from an economizer or an intermediate load is connected to inlet 24 of primary compressor 12. Alternatively, conduit 32 may be connected to conduit 20" in between the primary and booster compressors, or connected to conduit 20' in the booster compressor. In all of these configurations the economizer/intermediate load inlet bypasses the booster compressor.

Compressors 10 and 12 preferably comprise well known hermetic-type compressors. These types of compressors generally comprise a shell in which a reciprocating or rotary compressor and drive motor are housed. Compressors other than reciprocating or rotary types may be used in the present invention. As is conventional, the bottom of the shell contains a lubricating oil sump, the normal level of which is indicated in FIG. 1.

Referring again to FIG. 1, a pressure differential exist between the shell of booster compressor 10 and the shell of primary compressor 12 as result of conduit 20". More specifically, the pressure in the shell of booster compressor 10 is slightly greater than the pressure in the shell of primary compressor 12. It will be appreciated that this pressure$_{13}$ differential can be controlled by the selection of the diameter of conduit 20".

Further, sump conduit 30 is positioned slightly above the normal level of the lubricating oil sump in booster compressor 10 and above the lubricating oil sump in primary compressor 12, whereby oil flows from the high side sump (in booster compressor 10) to the low side sump (in primary compressor 12) when the level of the oil sump in booster compressor 10 exceeds the normal operating level. A low side sump compressor is one which has its inlet open to the shell and its outlet sealed to the compressor. A high side sump compressor is one which has its inlet sealed to the compressor and its outlet open to the shell. This flow is driven by the above described pressure differential. Accordingly, sump conduit 30 assures that the compressors will not run out of lubricant oil, e.g., by all of the lubricant ending up in one of the compressors. The interconnection configuration of the present invention, insures oil return from the system via conduits 14" or 20' to booster compressor 10 and conduit 30 to primary compressor 12.

Referring now to FIG. 1, refrigerant flow through the compressors is shown.

At the beginning of each cycle (heating or cooling) check valve 16 is open, primary compressor 12 is on and booster compressor 10 is off. Generally, cool primarily gas phase refrigerant is delivered from an evaporator (i.e., the low side of the system). However, at the beginning of each cycle there is liquid phase refrigerant in the system which is generally delivered to a receiver or accumulator located between the evaporator and the inlet of the compressor. In accordance with an important feature of the present invention, a receiver or accumulator is not required. This initial liquid phase refrigerant, indicated by arrow 40, is delivered through conduits 14 and 14' and flows through check valve 16 where it then flows through conduits 20 and 20' to outlet 22 of booster compressor 10 and then down into the sump of booster compressor 10. Any gas phase refrigerant, indicated by arrow 40', associated with this flow is delivered by conduits 20 and 20" to inlet 24 of primary compressor 12. The liquid phase refrigerant (and any oil therein) increases the level of the high side sump, whereby liquid phase refrigerant and oil, indicated by arrow 42, will flow to the low side sump through sump conduit 30, as described hereinbefore. Accordingly, the shell (or can) of booster compressor 10 acts as the receiver or accumulator of the prior art. Thereafter, primarily cool gas phase refrigerant from the evaporator will flow through conduits 14 and 14', check valve 16, and conduits 20 and 20" to inlet 24 of primary compressor 12. This gas phase refrigerant, indicated by arrow 40', is combined with generally gas phase refrigerant, indicated by an arrow 44, from a system economizer or intermediate load at inlet 24. An example of an intermediate load is a refrigerator section of a refrigerator/freezer. Of course, the system may not include an economizer or an intermediate load, in which event conduit 32 is eliminated. Primary compressor 12 compresses the refrigerant in the usual manner to deliver compressed gas phase refrigerant, indicated by an arrow 46, to the high side of the system by way of outlet 26 of primary compressor 12 and conduit 28.

Figure 2:
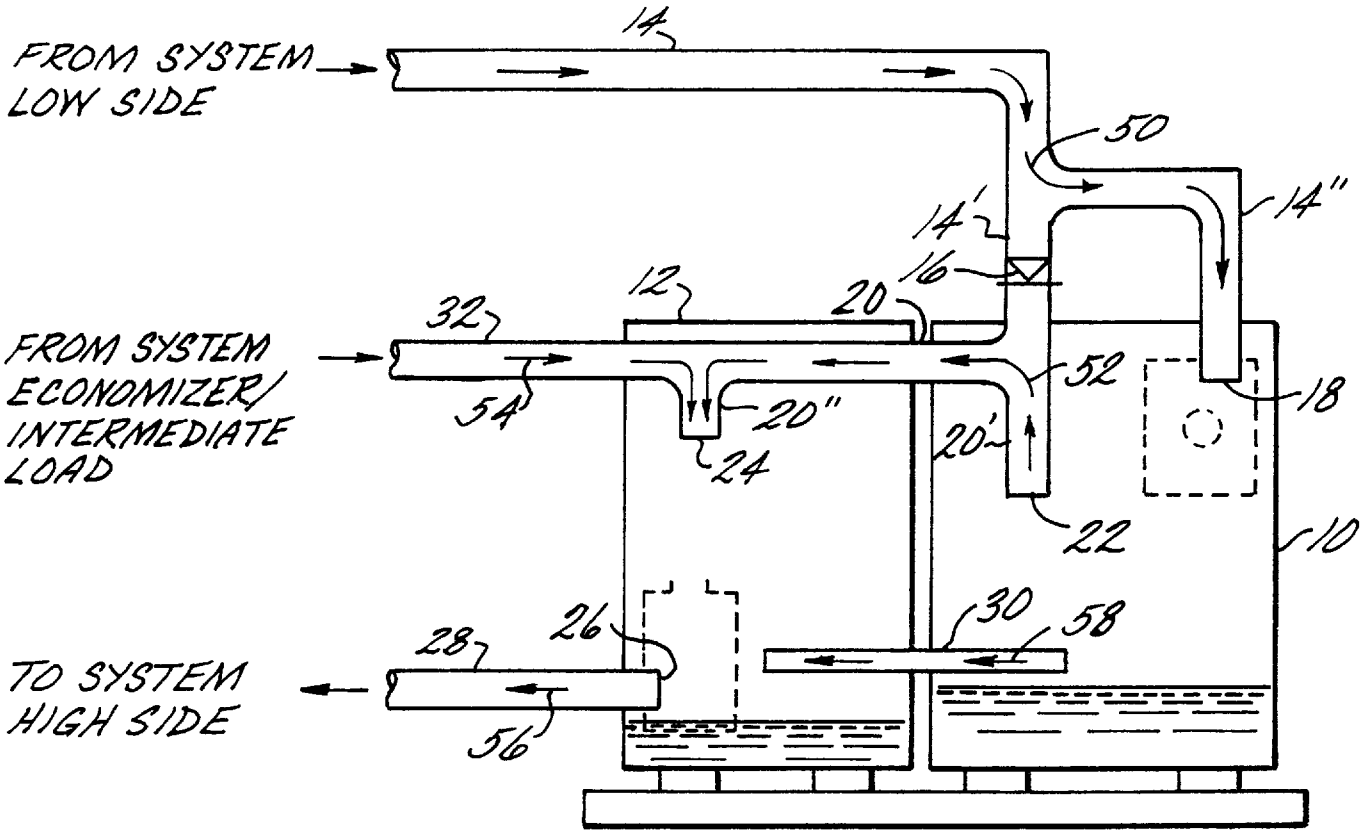
FIG. 2 is a diagrammatic sectional view of a primary and booster compressor in a second mode of operation.

Referring to FIG. 2, when booster compressor 10 is required, check valve 16 is closed and both the primary and booster compressors are on. Booster compressor 10 is only turned on when needed and only after primary compressor 12 has been operating for a period of time. Cool primarily gas phase refrigerant delivered from the evaporator (i.e., the low side of the system), indicated by arrow 50, is delivered through conduits 14 and 14" to inlet 18 of booster compressor 10 where the gas phase refrigerant is compressed in the usual manner to deliver compressed gas phase refrigerant, indicated by an arrow 52, at outlet 22 of booster compressor 10 through conduits 20' and 20" to inlet 24 of primary compressor 12. The compressed gas phase refrigerant, indicated by arrow 52, is combined with generally gas phase refrigerant, indicated by an arrow 44, from a system economizer or intermediate load at inlet 24 of primary compressor 12 where they are compressed in the usual manner to deliver compressed gas phase refrigerant, indicated by an arrow 56, to the high side of the system by way of outlet 26 of primary compressor 12 and conduit 28. Again, excess oil buildup in booster compressor 10 is prevented by the flow of oil, indicated by an arrow 58, from the high side sump to the low side sump through sump conduit 30, as described hereinbefore.

Figure 3:
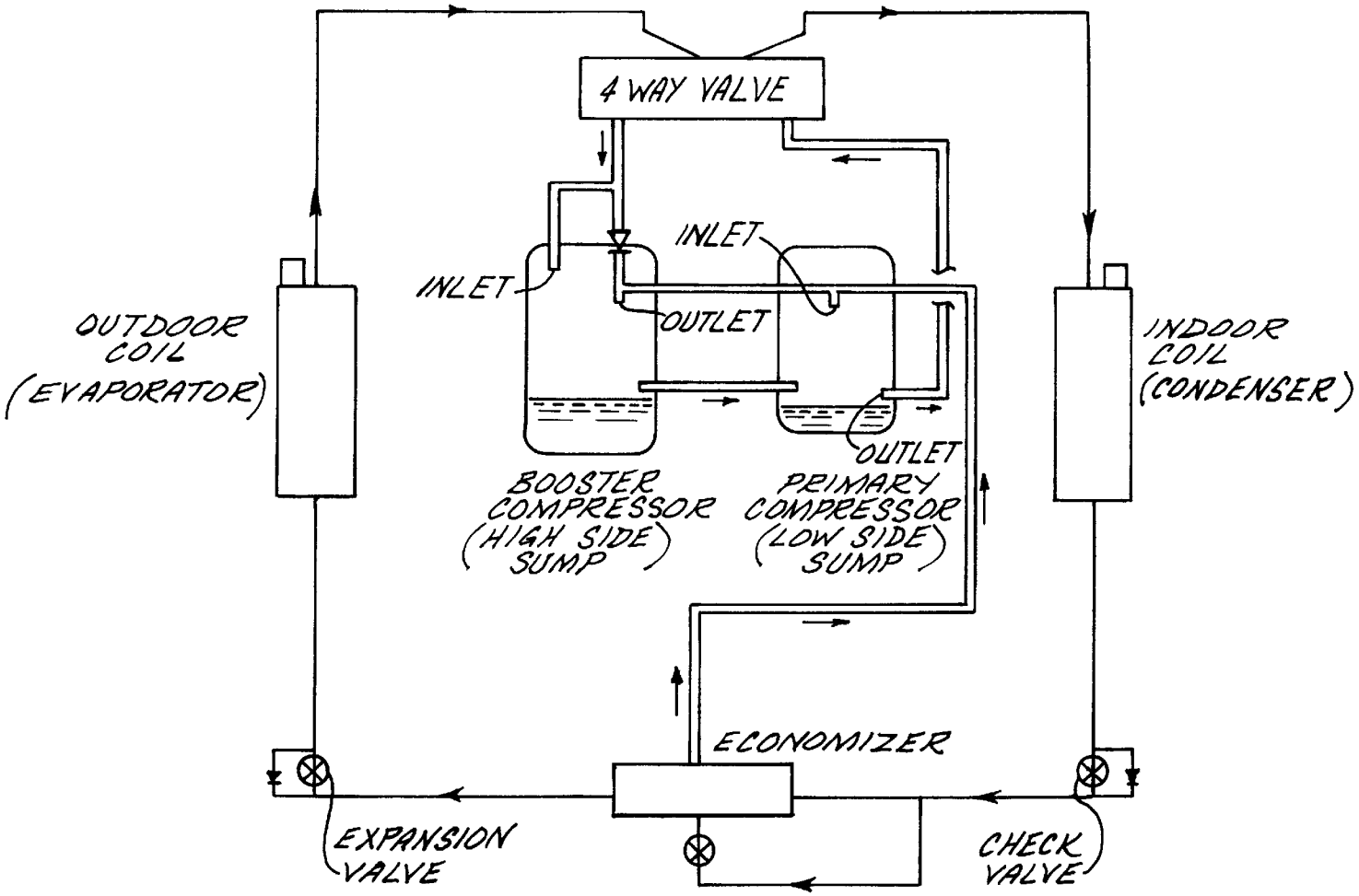
FIG. 3 is a diagrammatic view of the primary and booster compressors of FIGS. 1 and 2 in a heat pump system operating in a heating mode.
Figure 4:
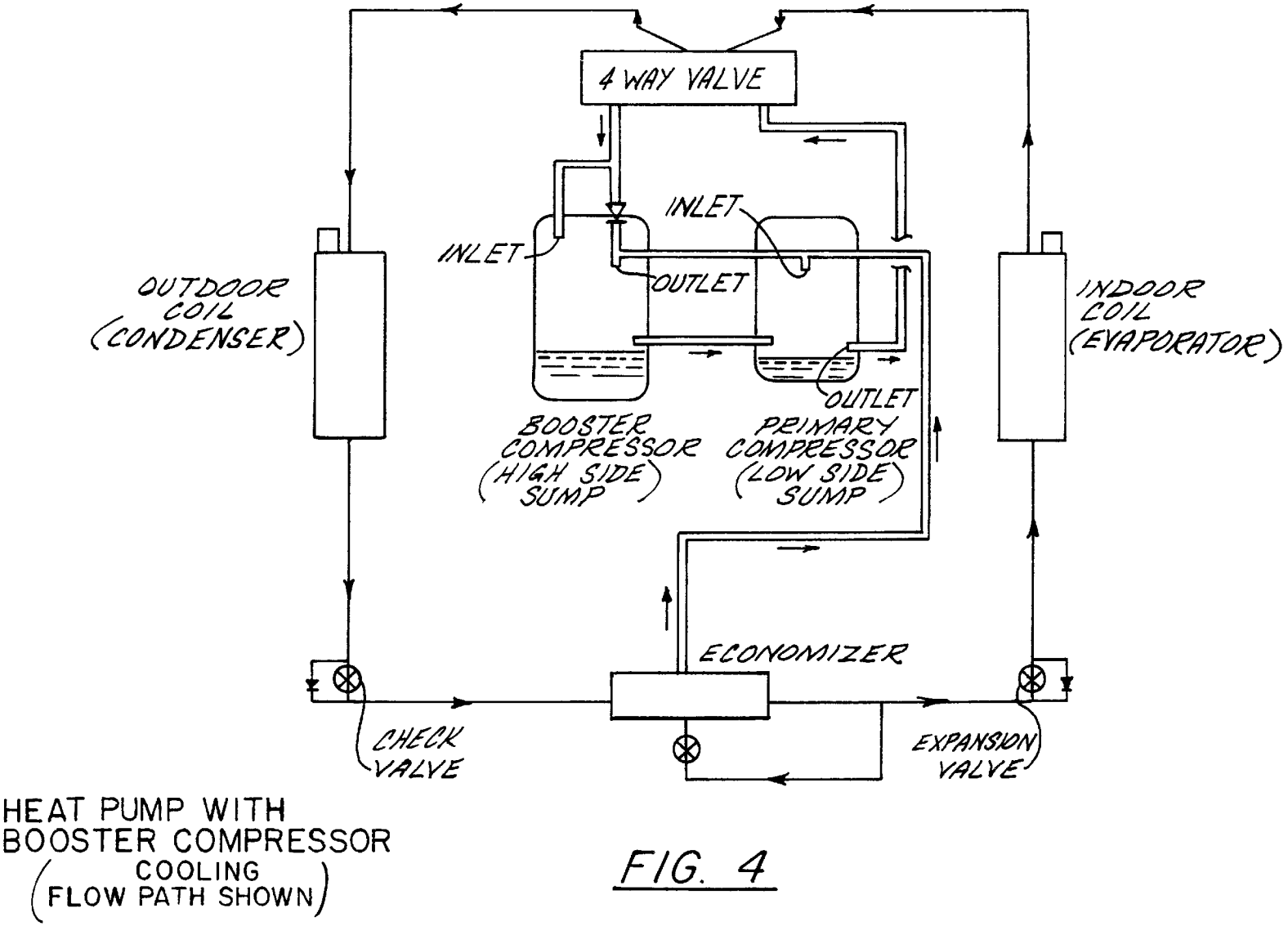
FIG. 4 is a diagrammatic view of the primary and booster compressors of FIGS. 1 and 2 in a heat pump system operating in a cooling mode.

Referring to FIGS. 3 and 4, the interconnecting configuration of the present invention is applied, by way of example only, to the boosted air source heat pump of U.S. Ser. No. 08/607,707. With the exception of the flow of refrigerant through the compressors as described above, the operation of the system is the same as that described in U.S. Ser. No. 08/607,707, which is not repeated herein but has been incorporated herein by reference, whereby reference should be made thereto for a description thereof. FIG. 3 shows the direction of refrigerant flow for heating and FIG. 4 shows the direction of refrigerant flow for cooling. It will however be appreciated that the interconnecting configuration of the present invention can also be employed in the refrigeration system of U.S. Pat. No. 4,748,820, as below with reference to FIG. 7, or any other system having primary and booster compressors, such being readily apparent to one of ordinary skill in the art.

Figure 5:
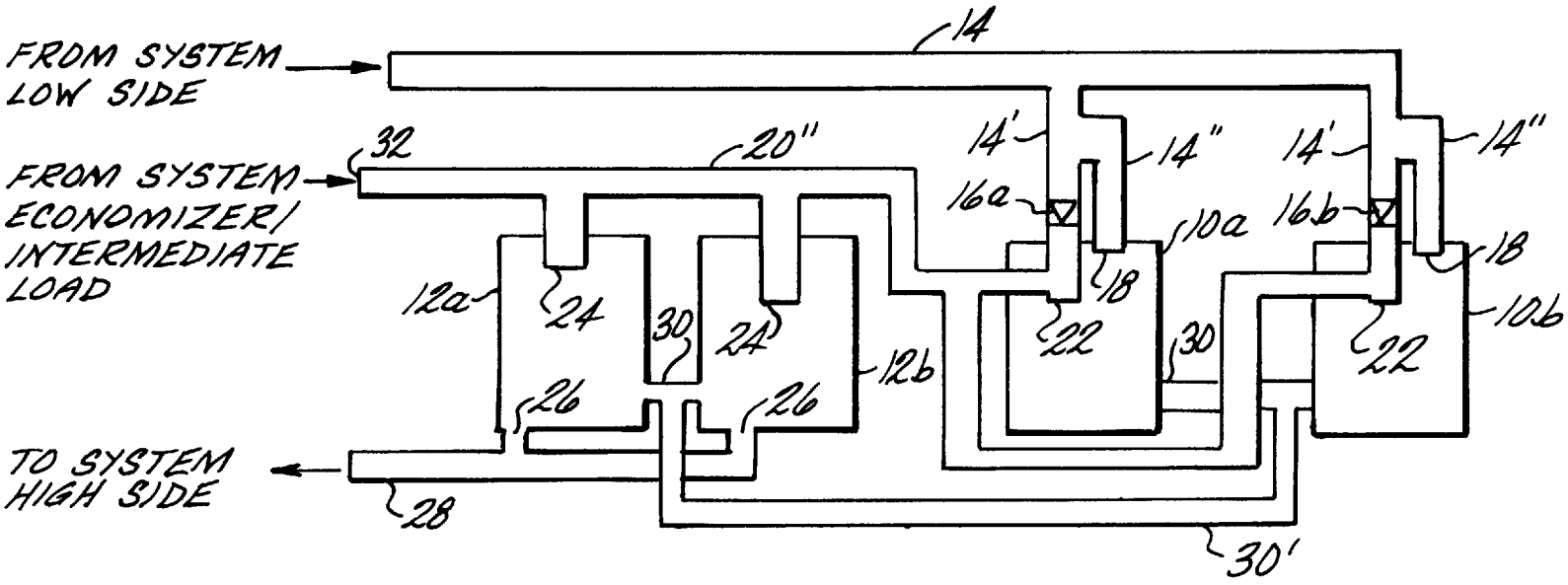
FIG. 5 is a diagrammatic view of a plurality of parallel primary compressors connected in series with a plurality of parallel booster compressors.

Referring to FIG. 5, a plurality of primary compressors 12*a*–12*b* (valved compressors) are coupled in parallel as is known in the art. The inlets 24 of the primary compressors 12*a* and 12*b* are coupled to a common conduit 20". The outlets 26 of the primary compressors 12*a* and 12*b* are connected to a common outlet 28 to the high side of the system. A sump conduit 30 couples the sumps of primary compressors 12*a*–12*b*. A plurality of booster compressors 10*a*–10*b* (valved compressors) are connected in parallel. The inlets 18 of the booster compressors 10*a*–10*b* are connected to a common conduit 14 from the low side of the system. The outlets 22 of the booster compressors 10*a*–10*b* are connected to conduit 20". Gas phase refrigerant may also be provided to a common conduit 20" through inlet 32 if the system includes an economizer or intermediate load. The check valves 16*a*–16*b* operate in a similar fashion as described above. In this embodiment, however, one or more booster compressors may be operating. This allows varying degrees of booster displacement to be achieved. The sump conduit 30' provides for the transfer of lubricant and liquid refrigerant contained therein from the booster compressors 10*a*–10*b* to the primary compressors 12*a*–12*b*. As described above with reference to FIGS. 1 and 2, there is a pressure differential between the booster compressors 10*a*–10*b* and the primary compressors 12*a*–12*b* to provide the force for the transfer of oil along conduit 30'. This prevents excess oil build up in the booster compressors 10*a*–10*b* and oil starvation in the primary compressors 12*a*–12*b*.

Figure 6:
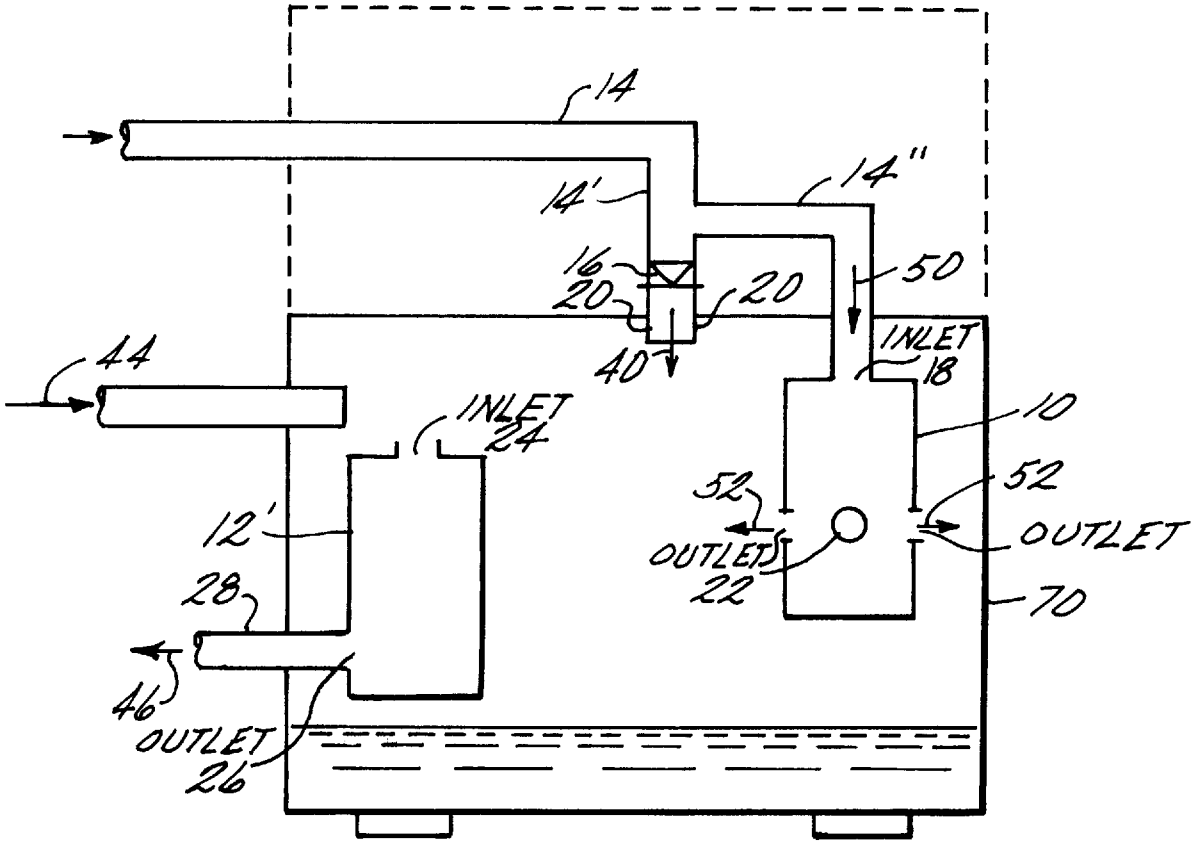
FIG. 6 is a diagrammatic sectional view of a series connected primary and booster compressor in a single can.

Referring to FIG. 6 a series connected primary compressor 12 and booster compressor 10 enclosed in a single can (shell or enclosure) 70 is generally shown. Can 70 can be extended, as shown by the broken line, to enclose conduit 14, 14', 14" 20 and check valve 16, whereby only two or three (with the economizer connection) connections to the can are required. The check valve 16 operates in a similar fashion as described above with reference to FIGS. 1 and 2. At the beginning of each cycle (heating or cooling) the check valve 16 is open, primary compressor 12 is on and booster compressor 10 is off. Generally, cool primarily gas phase refrigerant is delivered from an evaporator (i.e., the low side of the system). However, at the beginning of each cycle there is liquid phase refrigerant in the system which is generally delivered to a receiver or accumulator located between the evaporator and the inlet of the compressor. In accordance with an important feature of the present invention, a receiver or accumulator is not required. This initial liquid phase refrigerant, indicated by arrow 40, is delivered through conduits 14 and 14' and flows through check valve 16 where it then flows into the oil sump in the bottom of can 70. Any gas phase refrigerant associated with this flow is delivered into can 70 where it is collected by the inlet 24 of primary compressor 12. Thereafter, primarily cool gas phase refrigerant from the evaporator is delivered as described above. This gas phase refrigerant, indicated by arrow 40', is combined with generally gas phase refrigerant, indicated by an arrow 44, from a system economizer or intermediate load into can 70. Primary compressor 12 compresses the refrigerant in the usual manner to deliver compressed gas phase refrigerant, indicated by an arrow 46, to the high side of the system by way of outlet 26 of primary compressor 12 and conduit 28.

When booster compressor 10 is required, check valve 16 is closed and both the primary and booster compressors are on. Booster compressor 10 is only turned on when needed and only after primary compressor 12 has been operating for a period of time. Cool primarily gas phase refrigerant delivered from the evaporator (i.e., the low side of the system), indicated by arrow 50, is delivered through conduits 14 and 14" to inlet 18 of booster compressor 10 where the gas phase refrigerant is compressed in the usual manner to deliver compressed gas phase refrigerant at outlets 22 booster compressor 10 into can 70, where it is collected by the inlet 24 of primary compressor 12. The compressed gas phase refrigerant, indicated by arrow 52, is combined with generally gas phase refrigerant, indicated by an arrow 44, from a system economizer or intermediate load into can 70. Again, primary compressor 12 compresses the refrigerant in the usual manner to deliver compressed gas phase refrigerant, indicated by an arrow 46, to the high side of the system by way of outlet 26 of primary compressor 12 and conduit 28. By using a single can 70, the need for sump conduit 30 shown in FIGS. 1 and 2 is eliminated. The primary compressor 12 and the booster compressor 10 share a common oil sump formed in the bottom of can 70.

Figure 7:
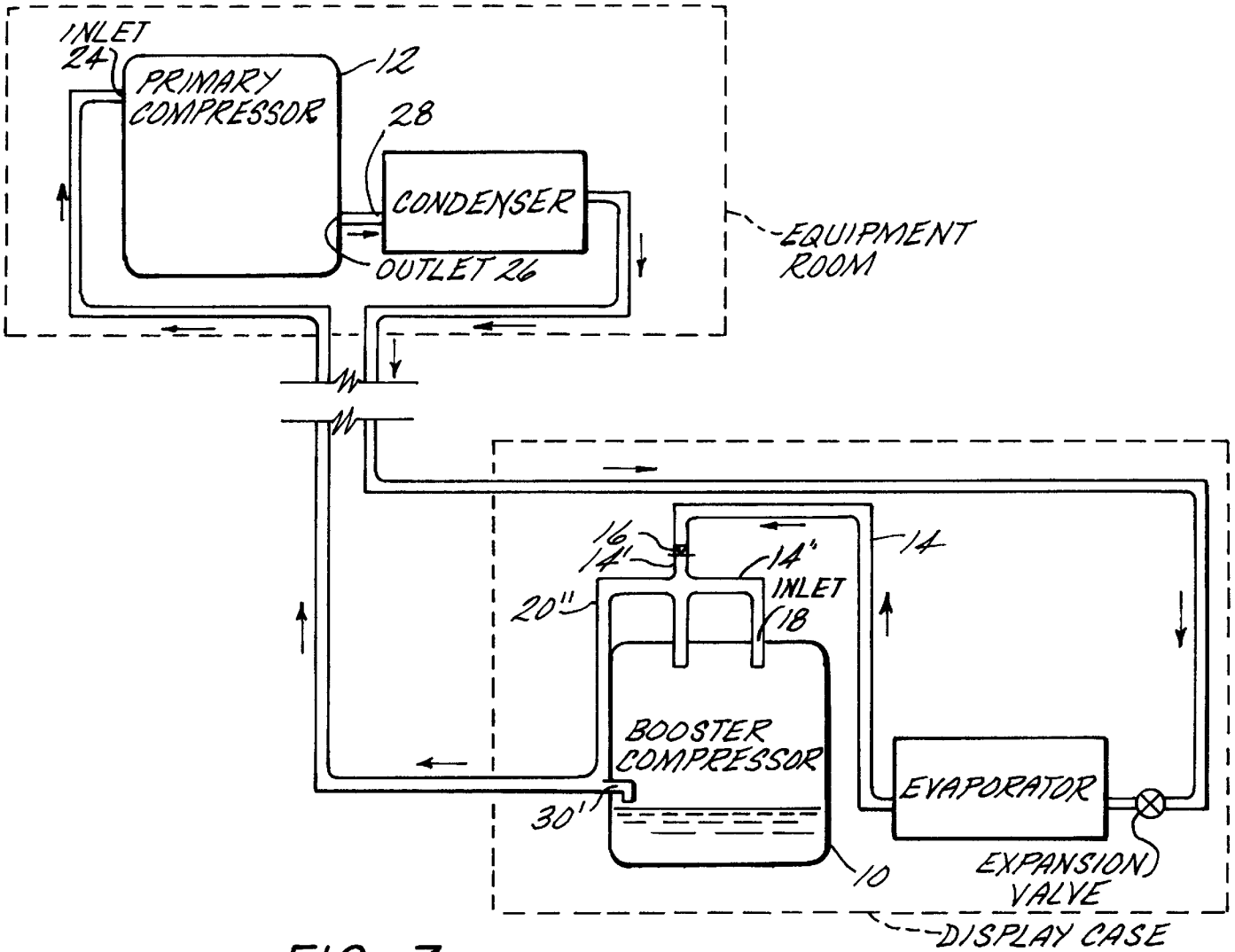
FIG. 7 is a diagrammatic view of the primary and booster compressors of FIGS. 1 and 2 in a refrigeration system.

Referring to FIG. 7, the interconnecting configuration of the present invention is applied, by way of example only, to the refrigeration system of U.S. Pat. No. 4,748,820 ('820). The equipment room portion of the system is similar to that described and shown in FIG. 1 of the '820 patent, except that receiver, oil separator and oil reservoir, shown in FIG. 2 of the '820 patent are no longer required. Further, while only one primary compressor is shown in FIG. 7 herein a plurality may be connected in parallel, as described hereinbefore and as shown in FIG. 1 of the '820 patent. The display case is the same as that described and shown in FIG. 1 of the '820 patent, except: for the connection to the booster compressor and the series connection between the booster compressor in the display case and the primary compressor in the equipment room. The booster compressor is connected as described hereinbefore, with the exception of the connection of sump conduit 30'. Conduit 30' is connected to conduit 20" which connects the outlet 22 of booster compressor 10 with the inlet 24 of primary compressor 12. The natural pressure differential from the outlet at the upper portion of the shell of the booster compressor down to conduit 30', slightly above the normal oil level of the sump, is sufficient to draw vapor and oil/liquid refrigerant, when it rises, into conduit 30'. It will be noted that the end of conduit 30' is turned downwardly toward the oil sump, whereby most of the oil droplets carried in the vapor will fall down into the sump rather than rise up into conduit 30'. Accordingly, the shell of the booster compressor acts as the receiver, oil separator and oil reservoir of the aforementioned prior art.

Further, while only a single display case is shown in FIG. 7 a plurality of display cases together with manifolds may be employed, as shown in FIG. 1 of the '820 patent.

The series connected primary and booster compressors of the present invention provide an efficient apparatus for heating /cooling and refrigeration applications. The shell of the booster compressor serves as the accumulator/receiver for excess liquid refrigerant. A conduit between the booster compressor and the primary compressor provides for migration of oil and liquid phase refrigerant therein from the booster compressor to the primary compressor, whereby excess oil build-up in the booster compressor and oil starvation in the primary compressor are prevented.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A compressor system comprising:

a first compressor having a high side sump, said first compressor having an inlet and an outlet; and a second compressor having a low side sump, said second compressor having an inlet and an outlet, said first compressor being connected in series with said second compressor.

2. The compressor system of claim 1 further comprising:

a conduit connecting said high side sump of said first compressor to said low side sump of said second compressor.

3. The compressor system of claim 1 further comprising:

a single enclosure housing said first compressor and said second compressor, said single enclosure forming a sump for both said first and second compressors.

4. The compressor system of claim 1 further comprising:

at least one additional first stage compressor connected in parallel with said first stage compressor; and at least one additional second stage connected in parallel with said second stage compressor.

5. The compressor system of claim 1 wherein said first and second stage compressor are hermetic-type compressors.

6. The compressor system of claim 1 farther comprising:

an economizer connected for communication with said inlet of said second stage compressor.

7. The compressor system of claim 1 wherein:

said system is a heating system.

8. The compressor system of claim 1 wherein:

said system is a refrigeration system.

9. The compressor system of claim 1 wherein:

said system is an air conditioning system.

10. The system of claim 1 wherein:

said high side sump and said low side sump contain oil; and the pressure in said high side sump is greater than the pressure in said low side sump to cause oil to flow from said high side sump to said low side sump when the oil level in said high side sump exceeds a predetermined level.

11. The system of claim 10 wherein:

the level of oil in said high side sump is normally higher than the level of oil in said low side sump.

12. The compressor system of claim 1 wherein:

said first compressor is a first stage compressor upstream of said compressor; and said second compressor is a second stage compressor downstream of said first compressor.

13. The compressor system of claim 12 wherein:

said first compressor is a booster compressor; and said second compressor is a primary compressor.

14. The compressor system of claim 1 wherein:

said first compressor is a booster compressor; and said second compressor is a primary compressor.

15. A compressor system comprising:

a first heat exchanger;

a second heat exchanger;

a conduit loop connecting said first and second heat exchangers;

a first stage compressor having a high side sump and a second stage compressor having a low side sump, said compressor being positioned between said first heat exchanger and said second heat exchanger in said conduit loop for circulating refrigerant therein, said first stage compressor being connected in series with said second stage compressor; and a conduit connecting said high side sump of said first stage compressor to said low side sump of said second stage compressor.

16. The system of claim 15 wherein said system is a heating system.

17. The system of claim 15 wherein said system is a refrigeration system.

18. The system of claim 15 wherein one of said first and second heat exchangers is an evaporator and the other one of said first and second heat exchangers is a condenser.

19. The system of claim 15 wherein said conduit loop comprises:

a first conduit connected to a low side load of the system, said first conduit being connected to an inlet to and an outlet from said first stage compressor; and a second conduit connected to a high side load of the system, said second conduit being connected to an outlet from said second stage compressor.

20. The system of claim 19 further comprising:

a check valve at said outlet of said first stage compressor.

21. The system of claim 20 further comprising:

a fourth conduit connected to an intermediate load of the system, said fourth conduit being connected to said inlet of said second stage compressor.

22. The system of claim 19 further comprising:

a third conduit connected to said outlet of said first stage compressor and the inlet of said second stage compressor.

23. The system of claim 15 farther comprising:

a single enclosure housing said first stage compressor and said second stage compressor, said single enclosure forming a sump for said first and second stage compressors.

24. The system of claim 15 further comprising:

at least one additional first stage compressor connected in parallel with said first stage compressor; and at least one additional second stage compressor connected in parallel with said second stage compressor.

25. The system of claim 15 wherein said first and second stage compressors are hermetic-type compressors.

26. The system of claim 15 further comprising:

an economizer connected for communication with said inlet of said second stage compressor.

27. The system of claim 15 wherein said system is an air conditioning system.

28. The system of claim 15 wherein:

said high side sump and said low side sump contain oil; and the pressure in said high side sump is greater than the pressure in said low side sump to cause oil to flow from said high side sump to said low side sump when the oil level in said high side sump exceeds a predetermined level.

29. The system of claim 28 wherein:

the level of oil in said high side sump is normally higher than the level of oil in said low side sump.

* * * * *